United States Patent [19]

Heinzl et al.

[11] Patent Number: 4,616,754

[45] Date of Patent: Oct. 14, 1986

[54] MANUFACTURE OF TRAY HOLDER FROM SINGLE MOLDED ARTICLE

[75] Inventors: Burno Heinzl; Herbert Frowein; Hartmut Stiegler, all of Herborn; Joachim Würz, Driedorf; Horst Schmidt, Trinkenstein; Willi Huttel, Ehringshausen; Karl-Heinz Schmitz, Herborn-Seelbach, all of Fed. Rep. of Germany

[73] Assignee: Buderus Aktiengesellschaft, Wetzlar, Fed. Rep. of Germany

[21] Appl. No.: 593,874

[22] Filed: Mar. 27, 1984

[30] Foreign Application Priority Data

Mar. 28, 1983 [DE] Fed. Rep. of Germany ... 8309164[U]

[51] Int. Cl.[4] ..... A47G 29/00

[52] U.S. Cl. ..... 211/71; 211/126; 264/328.1

[58] Field of Search ..... 211/71, 126, 59.2, 183; 298/DIG. 9; 312/257 SM, 258, 108, 330 R; 264/328.1

[56] References Cited

U.S. PATENT DOCUMENTS

| | | | |
|---|---|---|---|
| 785,591 | 3/1905 | Coney | 211/71 X |
| 1,342,269 | 6/1920 | Stewart | 32/258 |
| 3,298,763 | 1/1967 | Domenico | 211/71 X |
| 3,963,125 | 6/1976 | Baggott | 211/71 X |
| 4,274,687 | 6/1981 | Bayles et al. | 211/126 X |
| 4,287,992 | 9/1981 | Takemori | 211/59.2 |
| 4,463,684 | 5/1984 | Klungle | 211/126 X |

FOREIGN PATENT DOCUMENTS

| | | | |
|---|---|---|---|
| 2041726 | 9/1980 | United Kingdom | 211/126 |

*Primary Examiner*—Ramon S. Britts
*Assistant Examiner*—Sarah A. L. Eley
*Attorney, Agent, or Firm*—Karl F. Ross; Herbert Dubno

[57] ABSTRACT

An article for mixing a tray holder has a generally rectangular side panel having upper and lower edges and inner and outer faces, a generally rectangular roof panel projecting generally perpendicular from the inner face of the side panel along the upper edge thereof, and a generally rectangular floor panel projecting generally perpendicular from the inner face of the side panel along the lower edge thereof. These panels are formed along a plane perpendicularly to and bisecting all panels with a weakened region and the roof and floor panels have straight outer edges remote from the side panel that are complementarily shaped to opposite sides of the plane. Thus according to the invention the article can be subdivided into two complementary and interfitting pieces along the plane adn joined together to make a half-depth holder by bonding together the complementary outer edges. A full-depth holder can be made by bonding together the outer edges of two such articles. Thus it is possible with a single such article made by a single mold to make single or double-depth holders. Manufacturing costs are thereby held down.

8 Claims, 5 Drawing Figures

MANUFACTURE OF TRAY HOLDER FROM SINGLE MOLDED ARTICLE

FIELD OF THE INVENTION

The present invention relates to the manufacture of a holder for traylike objects, such as is used to hold the food trays used in an airliner. More particularly this invention concerns the mass-production manufacture of such a holder from a molded synthetic-resin.

BACKGROUND OF THE INVENTION

A so-called tray holder basically has a pair of parallel and upright sides carrying tray guides, and a roof and a floor vertically bounding the space between the sides. This holder is frequently used around food, typically during the transport and storage of preprepared meals, so must be of an impervious easy-to-clean material, and must be made at low cost as the users of such devices—airlines, large catering firms—need large quantities of them. In addition, since such an item is relatively large, often most of a meter tall and about a meter deep, and is of closed shape, it must be made of two pieces joined together along a plane extending parallel to and midway between the sides. This necessitates making two separate pieces, normally one piece with a female groove along the outer edges of its roof and floor panels and another piece with a male ridge along the outer edges of the roof and floor panels. Normally these pieces are made by high-pressure injection molding of a thermoplastic polymer such as polystyrol or polyurethane.

Such two-piece is construction is expensive because it requires that two molds be made and operated. The costs for machining a mold can represent a considerable portion of the cost of the articles produced by it, so the price of the thus manufactured holder can be high.

In addition it is standard to provide the holders in at least two different sizes, typically either a one-tray depth or a two-tray depth. Thus it is necessary to provide different molds for the different sizes, again doubling mold costs while increasing other production costs considerably. Just connecting together two single-depth holders to make a double holder is an expensive procedure that leaves an unsanitary transverse joint right at the tray guides.

OBJECTS OF THE INVENTION

It is therefore an object of the present invention to provide an improved holder and method of making same.

Another object is the provision of such a holder and method of making same which overcome the above-given disadvantages.

A further object is to provide a molded article from which half-depth and full-depth holders can be made using at most one other such molded article.

SUMMARY OF THE INVENTION

An article for making a tray holder according to the invention has a generally rectangular side panel having upper and lower edges and inner and outer faces, a generally rectangular roof panel projecting generally perpendicularly from the inner face of the side panel along the upper edge thereof, and a generally rectangular floor panel projecting generally perpendicularly from the inner face of the side panel along the lower edge thereof. These panels are formed along a plane perpendicular to and bisecting all panels with a weakened region and the roof and floor panels have straight outer edges remote from the side panel that are complementarily shaped to opposite sides of the plane. Thus according to the invention the article can be subdivided into two complementary and interfitting pieces along the plane and joined together to make a half-depth holder by bonding together the complementary outer edges. A full-depth holder can be made by bonding together the outer edges of two such articles. Thus it is possible with a single such article made by a single mold to make single or double-depth holders. Manufacturing costs are thereby held down.

Such an article can be produced at very low cost, and in fact the manufacturer need not even figure out in advance how many full-depth holders need be made and how many half-depth ones, since with a large stock of the articles according to this invention full- and half-depth ones can be made up with equal ease.

The outer edges according to this invention can be differently but complementarily shaped to each side of the plane. More particularly the outer edges are male to one side of the plane and complementarily female to the other side thereof. They may also be Z-shaped, so each is partially male and partially female.

The article of this invention also has a generally rectangular middle panel projecting generally perpendicularly from the inner face of the side panel between the upper and lower edges thereof. This middle panel has a straight outer edge remote from the side panel and complementarily shaped to opposite sides of the plane. Thus when the article is subdivided and joined together the two sections of the middle-panel outer edge meet.

In addition according to this invention the side panel is formed with at least two cooling canals extending on the inner face parallel to and symmetrically flanking the plane. Furthermore, the side wall is formed on its inner face with guides extending parallel to the upper and lower edges.

DESCRIPTION OF THE DRAWING

The above and other features and advantages will become more readily apparent from the following, reference being made to the accompanying drawing in which.

SPECIFIC DESCRIPTION

Figure 1:
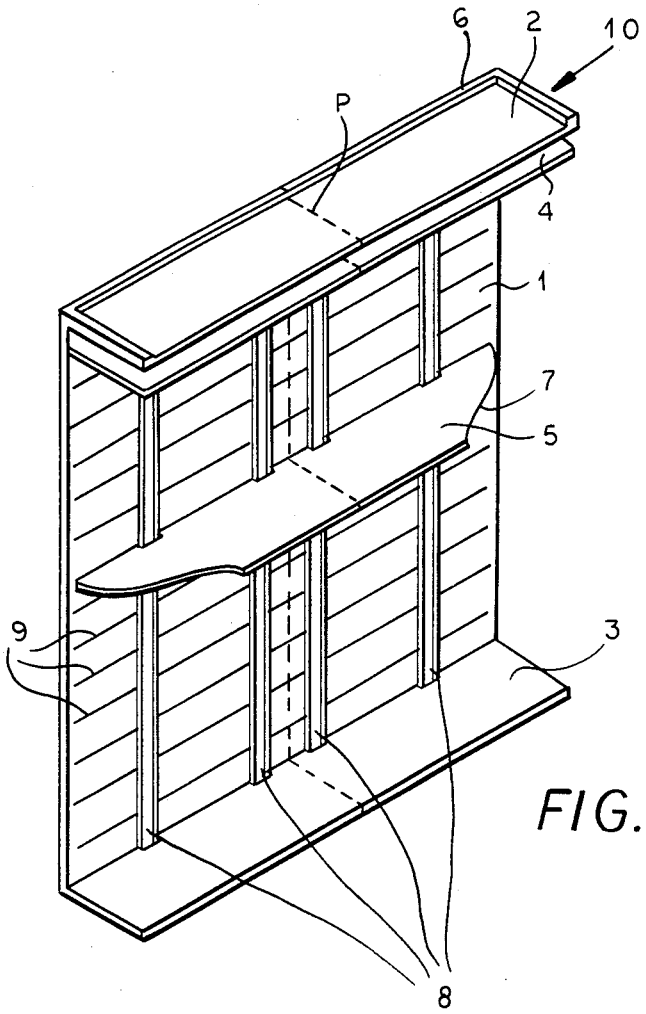
FIG. 1 is a perspective view of the article according to this invention.

As seen in FIG. 1 an article or construction element 10 according to this invention basically has a rectangular and flat side panel 1 having a top panel 2 extending perpendicularly from it just below its upper edge to form a rim 6 and a similar such floor panel 3 projecting perpendicularly from its lower edge, the top and bottom panels 2 and 3 being substantially identical. Another upper panel 4 projects from the inner face of the panel 1 immediately below the top panel 2, defining a slot therewith, and a central stiffening panel 5 projects from the inner face about in its middle. The outer corners of the stiffening panel 5 are cut out at 7, and the inner face of the panel 1 is formed with cooling channels 8 extending between the upper and lower panels 2 and 3. In addition the inner face of the panel 1 is formed with a plurality of longitudinal guide rails 9 extending parallel to the upper and lower panels 2 and 3 and spaced apart by the height of the loaded tray to be used in the finished product.

This entire article 10 is symmetrical about a plane P that bisects all the panels 1 through 5, and the cut corners 7 and channels 8 are arranged symmetrically with respect to this plane P. The panels 1 through 5 are weakened along the plane P, for instance by forming a groove 11 (FIG. 3) at this location so that the element 10 can be broken into two spectrally identical parts along this plane P.

Figure 4:
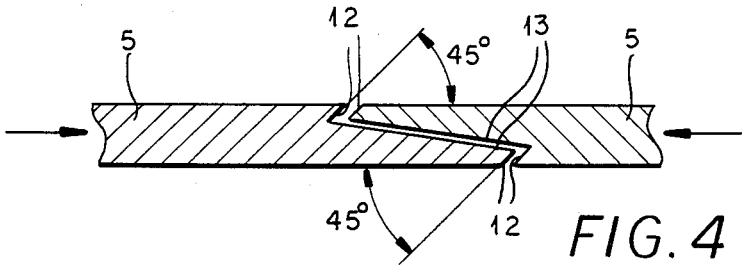
FIG. 4 is a large-scale section taken along plane IV—IV of FIG. 3.

In addition the outer edges of the panels 2 through 5, that is their edges parallel to but turned away from the panel 1, are given a Z-profile as shown in FIG. 4, but this profile is symmetrically opposite to each side of the plane P. More particularly each such edge has three edge portions, two parallel narrow ones 12 (FIG. 4) which each account for a third of the thickness of the respective panel 5 and of which the outer one forms an angle of 135° to the respective face and the inner one forms an angle of 45° to the respective face, and a middle portion 13 which joins these two portions 12 and that extends at an angle of about 10° to the panel faces.

The article 10 is injection molded of a synthetic resin such as polystyrol or polyurethane under high pressure according to the so-called TSG process to produce a smooth finish. Such manufacture can produce an article to very accurate tolerances.

Figure 2A:
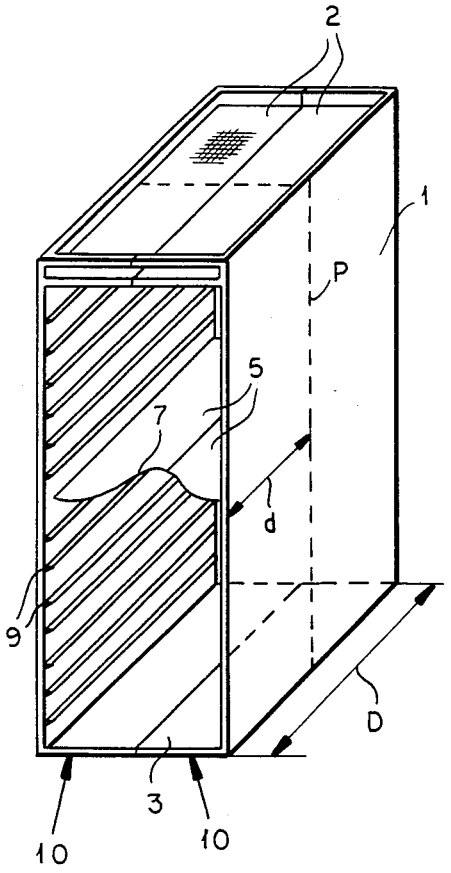
FIGS. 2*a* and 2*b* are perspective views of two holders made with articles according to this invention.

It is possible as shown in FIG. 2*a* to join two complete articles 10 together simply by fitting together the complementary outer ends of the panels 2 through 5. This forms a tray holder of a depth D equal to the full longitudinal depth D of the article 10. An adhesive is applied to the surfaces 12 and 13 and the two articles 10 are pushed together perpendicular to the panels 1, forming a very rigid assembly.

Figure 2B:
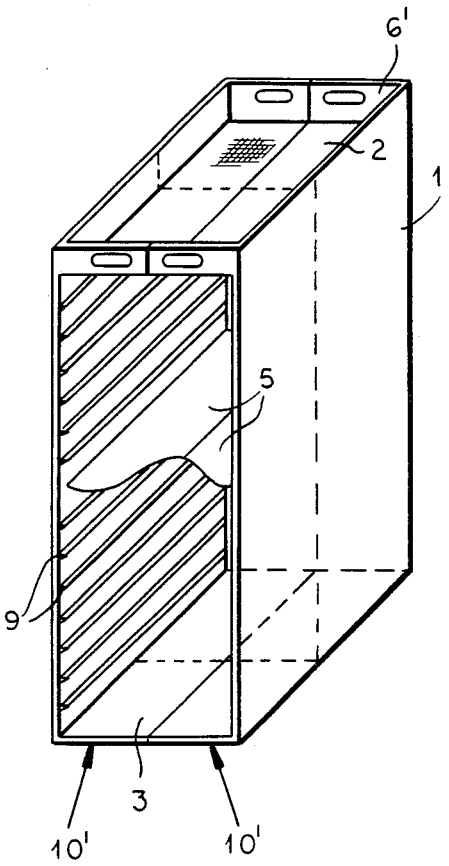

The same procedures are followed for an article 10' such as shown in FIG. 2*b* which has no panels 4 and an extra-deep rim 6'.

Figure 3:
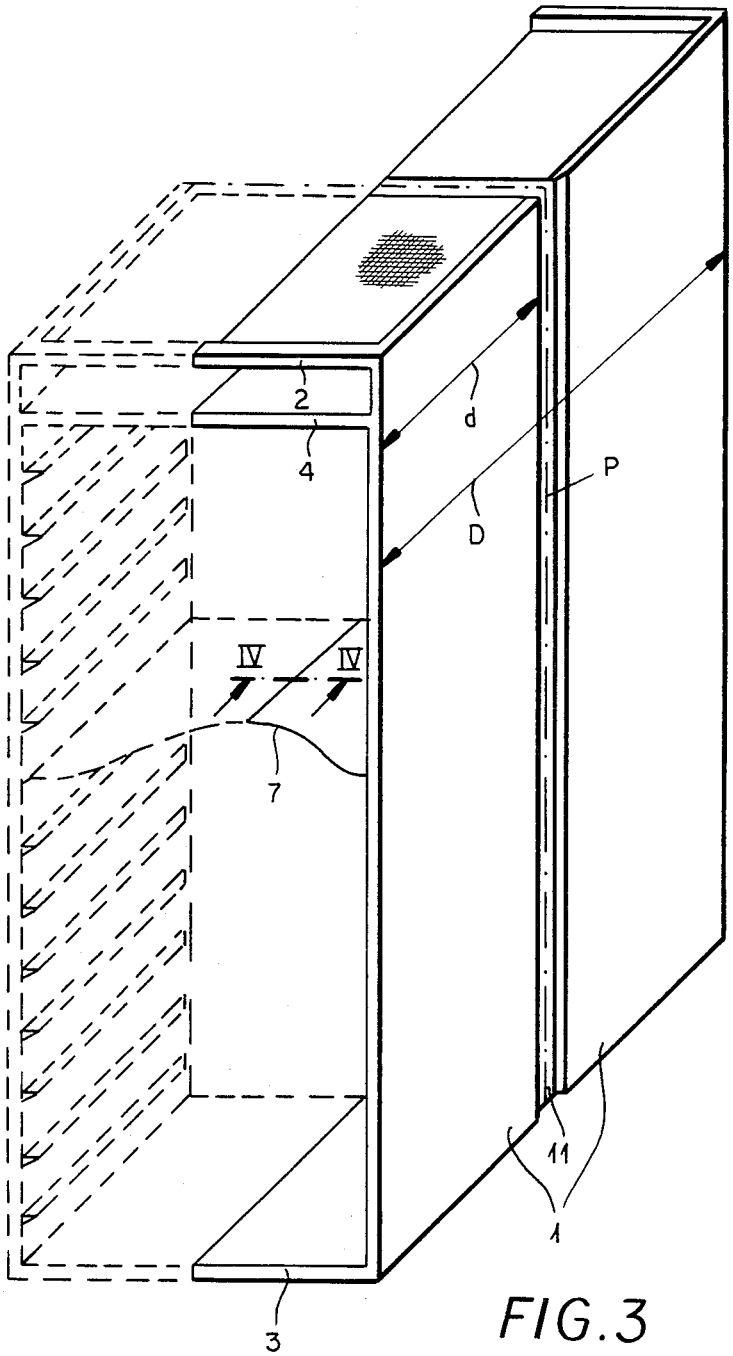
FIG. 3 illustrates the construction of a half-depth holder with the article of FIG. 1.

It is also possible according to this invention to break one of the articles 10 apart along the plane P as shown in FIG. 3, and to then fit the two halves together as illustrated, with the two cut corners 7 together. This produces a holder of half depth d. Once again as illustrated in FIG. 4, the grooves formed by the inner edge portions 12 and the intermediate edge portions 13 will receive the complementary parts of the other parts and allow a solid joint to be made.

It is therefore possible, starting from a single article of manufacture, to make a full-depth holder or a half-depth holder. Only a single mold need be constructed and a single element manufactured, greatly reducing costs while still producing a high-quality item.

We claim:

1. An article for making a tray holder, the article comprising:

a generally rectangular side panel having upper and lower edges and inner and outer faces;

a generally rectangular roof panel projecting generally perpendicularly from the inner face of the side panel along the upper edge thereof; and a generally rectangular floor panel projecting generally perpendicularly from the inner face of the side panel along the lower edge thereof, the panels being unitary and formed along a plane perpendicular to and bisecting all panels with a weakened region, the roof and floor panels having straight outer edges remote from the side panel that have a predetermined male profile to one side of the plane and a complementary female profile to the opposite side of the plane, whereby the article can be subdivided at the region into two complementary and interfitting pieces along the plane and joined together to make a holder by bonding together the complementary outer edges.

2. The article defined in claim 1, further comprising:

a generally rectangular middle panel projecting generally perpendicularly from the inner face of the side panel between the upper and lower edges thereof, the middle panel having a straight outer edge remote from the side panel and complementarily shaped to opposite sides of the plane, whereby when the article is subdivided and joined together the two sections of the middle-panel outer edge meet.

3. The article defined in claim 1 wherein the outer edges are Z-shaped.

4. The article defined in claim 1 wherein the side panel is formed with at least two cooling canals extending on the inner face parallel to and symmetrically flanking the plane.

5. The article defined in claim 1 wherein the side wall is formed on its inner face with guides extending parallel to the upper and lower edges.

6. A method of manufacturing a tray holder having a pair of parallel and upright sides carrying tray guides, and a roof and a floor vertically bounding the space between the sides, the method comprising:

molding an article having a generally rectangular side panel having upper and lower edges and inner and outer faces, a generally rectangular roof panel projecting generally perpendicularly from the inner face of the side panel along the upper edge thereof, and a generally rectangular floor panel projecting generally perpendicularly from the inner face of the side panel along the lower edge thereof, the article being formed along a plane perpendicular to and bisecting all the panels with a weakened region, the roof and floor panels having straight outer edges remote from the side panel that have a predetermined male profile to one side of the plane and a complementary female profile to the opposite side of the plane;

subdividing the article into two complementary and interfitting pieces at the region along the plane; and fitting and then joining together the outer edges of the subdivided article, thereby completing the holder.

7. The manufacturing method defined in claim 1 wherein the article is unitarily injection molded.

8. A method of manufacturing a tray holder having a pair of parallel and upright sides carrying tray guides, and a roof and a floor vertically bounding the space between the sides, the method comprising:

molding a pair of identical articles each having a generally rectangular side panel having upper and lower edges and inner and outer faces, a generally rectangular roof panel projecting generally perpendicularly from the inner face of the side panel along the upper edge thereof, and a generally rectangular floor panel projecting generally perpendicularly from the inner face of the side panel along the lower edge thereof, the roof and floor panels having straight outer edges remote from the side panel that have a predetermined male profile to one side of a plane perpendicular to and bisecting all the panels and a complementary female profile to the opposite side of the plane; and fitting and then joining together the outer edges of the two identical articles with the male profile of one of the articles fitting with the female profile of the other article and vice versa, thereby completing the holder.

* * * * *